US010391515B1

(12) United States Patent
Kerlin

(10) Patent No.: US 10,391,515 B1
(45) Date of Patent: Aug. 27, 2019

(54) VISCOUS FLUID APPLICATOR PUMP

(71) Applicant: Andrew Norman Kerlin, Minden, NV (US)

(72) Inventor: Andrew Norman Kerlin, Minden, NV (US)

( * ) Notice: Subject to any disclaimer, the term of this patent is extended or adjusted under 35 U.S.C. 154(b) by 0 days.

(21) Appl. No.: 15/976,875

(22) Filed: May 11, 2018

(51) Int. Cl.

| | |
|---|---|
| ***B05C 5/02*** | (2006.01) |
| ***B05C 11/10*** | (2006.01) |
| ***B05B 11/00*** | (2006.01) |
| ***B05C 7/04*** | (2006.01) |
| ***B05C 17/005*** | (2006.01) |

(52) U.S. Cl.
CPC ..... *B05C 5/0208* (2013.01); *B05B 11/3025* (2013.01); *B05C 5/0241* (2013.01); *B05C 7/04* (2013.01); *B05C 11/1039* (2013.01); *B05C 17/00569* (2013.01); *B05D 2254/06* (2013.01)

(58) Field of Classification Search
USPC ..... 156/305, 307.1, 307.3, 546, 547, 578
See application file for complete search history.

(56) References Cited

U.S. PATENT DOCUMENTS 2,028,912 A * 1/1936 Maulis ..... F04B 15/02 222/380
2,096,907 A * 10/1937 Linderman ..... F04B 1/24 91/500
2,331,435 A * 10/1943 Stambaugh ..... B67D 7/02 137/1
2,530,673 A * 11/1950 Zinszer ..... F04B 47/02 166/105
2,567,513 A * 9/1951 Haines ..... E21B 43/12 166/62
2,596,146 A * 5/1952 Haines ..... F04B 47/00 417/90
2,624,288 A * 1/1953 Reilly ..... E21B 43/12 417/448
2,632,401 A * 3/1953 Mong ..... E21B 43/12 92/133
2,672,815 A * 3/1954 Eadie ..... F04B 47/00 417/85
2,689,535 A * 9/1954 Martin ..... F04F 1/00 417/546
2,777,394 A * 1/1957 Modrovsky ..... F04D 5/001 415/113
2,821,205 A * 1/1958 Chilton ..... F15D 1/06 137/13
2,851,197 A * 9/1958 Colton ..... F23K 5/20 222/146.5

(Continued)

FOREIGN PATENT DOCUMENTS

EP 2133152 A1 * 12/2009 ..... B05B 11/3032

OTHER PUBLICATIONS

English Abstract of EP 2133152 (Year: 2019).*

*Primary Examiner* — Sing P Chan

(57) ABSTRACT

An applicator assembly may include an applicator member and a pump. The applicator member may include an applicator surface substantially matching a surface of a pipe or fitting. The pump may cause a fluid to flow via one or more channels onto the applicator surface. When the pipe or fitting is positioned within or around the applicator surface the pump causes the fluid to flow between the applicator surface and the surface of the pipe or fitting applying the fluid to the surface of the pipe or fitting.

20 Claims, 13 Drawing Sheets

(56) References Cited

U.S. PATENT DOCUMENTS 2,855,861 A * 10/1958 Miles ..... F04F 5/461 417/182.5
2,865,540 A * 12/1958 Gray ..... F16N 5/00 222/341
2,895,644 A * 7/1959 Pande ..... G05D 11/132 192/47
2,952,210 A * 9/1960 Clancy ..... F04B 43/10 417/383
3,827,397 A * 8/1974 Hebberling ..... C03C 25/20 118/50
4,014,629 A * 3/1977 Elsworth ..... F04B 15/02 417/259
4,047,854 A * 9/1977 Penn ..... F04B 7/04 417/489
4,073,409 A * 2/1978 Gardner ..... F04B 23/023 222/146.5
4,075,976 A * 2/1978 Clayton ..... B05C 5/002 118/324
4,240,567 A * 12/1980 Gardner ..... B05C 11/10 222/146.5
4,483,665 A * 11/1984 Hauser ..... F04B 43/107 417/401
4,629,094 A * 12/1986 Vogel ..... E04D 15/07 222/82
4,699,575 A * 10/1987 Geisel ..... F04C 2/086 277/365
4,787,332 A * 11/1988 Geisel ..... F04C 2/086 118/410
4,808,084 A * 2/1989 Tsubouchi ..... F04B 43/04 310/328
4,822,250 A * 4/1989 Tsubouchi ..... F04B 43/04 417/322
5,137,368 A * 8/1992 Kistner ..... B01F 5/14 137/565.29
5,415,531 A * 5/1995 Cavanaugh ..... F04B 9/133 277/636
5,429,193 A * 7/1995 Hegebarth ..... F04B 47/02 166/369
5,816,453 A * 10/1998 Spencer ..... B05B 11/007 222/321.3
6,053,709 A * 4/2000 Reavis ..... F04B 9/135 417/401
6,093,003 A * 7/2000 Hauser ..... B60T 8/4031 417/523
6,800,069 B2 * 10/2004 Lampropoulos .... A61M 5/1483 604/140
7,011,507 B2 * 3/2006 Seto ..... F04B 43/046 417/307
7,056,096 B2 * 6/2006 Takagi ..... F04B 43/046 417/413.2
7,131,555 B2 * 11/2006 Maruyama ..... B05C 5/0225 222/1
7,182,750 B2 * 2/2007 Lampropoulos .... A61M 5/1483 604/140
7,595,470 B1 * 9/2009 Sizer ..... H05B 6/802 219/686
7,654,418 B2 * 2/2010 Law ..... B05B 11/3001 222/259
7,690,535 B2 * 4/2010 Law ..... B05B 11/3001 222/153.13
7,891,522 B2 * 2/2011 Law ..... B05B 11/3001 222/1
7,954,674 B2 * 6/2011 Roy ..... B05B 11/3023 222/321.6
7,954,677 B2 * 6/2011 Langlois ..... B05B 11/3007 222/321.9
8,333,567 B2 * 12/2012 Watts ..... F04B 15/02 417/490
9,969,023 B2 * 5/2018 Ishikawa ..... B23K 1/08
2003/0208158 A1 * 11/2003 Lampropoulos .... A61M 5/1483 604/140
2004/0013548 A1 * 1/2004 Seto ..... F04B 43/046 417/505
2004/0018100 A1 * 1/2004 Takagi ..... F04B 43/046 417/322
2004/0118865 A1 * 6/2004 Maruyama ..... B05C 5/0225 222/1
2004/0167471 A1 * 8/2004 Lampropoulos .... A61M 5/1483 604/140
2006/0043118 A1 * 3/2006 Law ..... B05B 11/3001 222/321.9
2006/0261186 A1 * 11/2006 Fontaine ..... B05B 9/0816 239/302
2007/0018015 A1 * 1/2007 Amron ..... B05B 3/02 239/332
2008/0118368 A1 * 5/2008 Roy ..... B05B 11/3023 417/36
2008/0197149 A1 * 8/2008 Law ..... B05B 11/3001 222/153.13
2008/0210713 A1 * 9/2008 Langlois ..... B05B 11/3007 222/321.9
2009/0087319 A1 * 4/2009 Russold ..... F04B 49/065 417/45
2010/0089945 A1 * 4/2010 Law ..... B05B 11/3001 222/1
2011/0150675 A1 * 6/2011 Watts ..... F04B 15/02 417/375
2017/0066072 A1 * 3/2017 Ishikawa ..... B23K 1/08
2017/0328361 A1 * 11/2017 Tu ..... F04B 53/10
2018/0347553 A1 * 12/2018 Lee ..... F04B 5/02
2019/0063428 A1 * 2/2019 Tix ..... F04B 53/126

* cited by examiner

VISCOUS FLUID APPLICATOR PUMP

TECHNICAL FIELD

The present disclosure relates to applicators for fluids such as applicators for applying viscous bonding fluids to pipes or pipe fittings.

DETAILED DESCRIPTION

Figure 1:
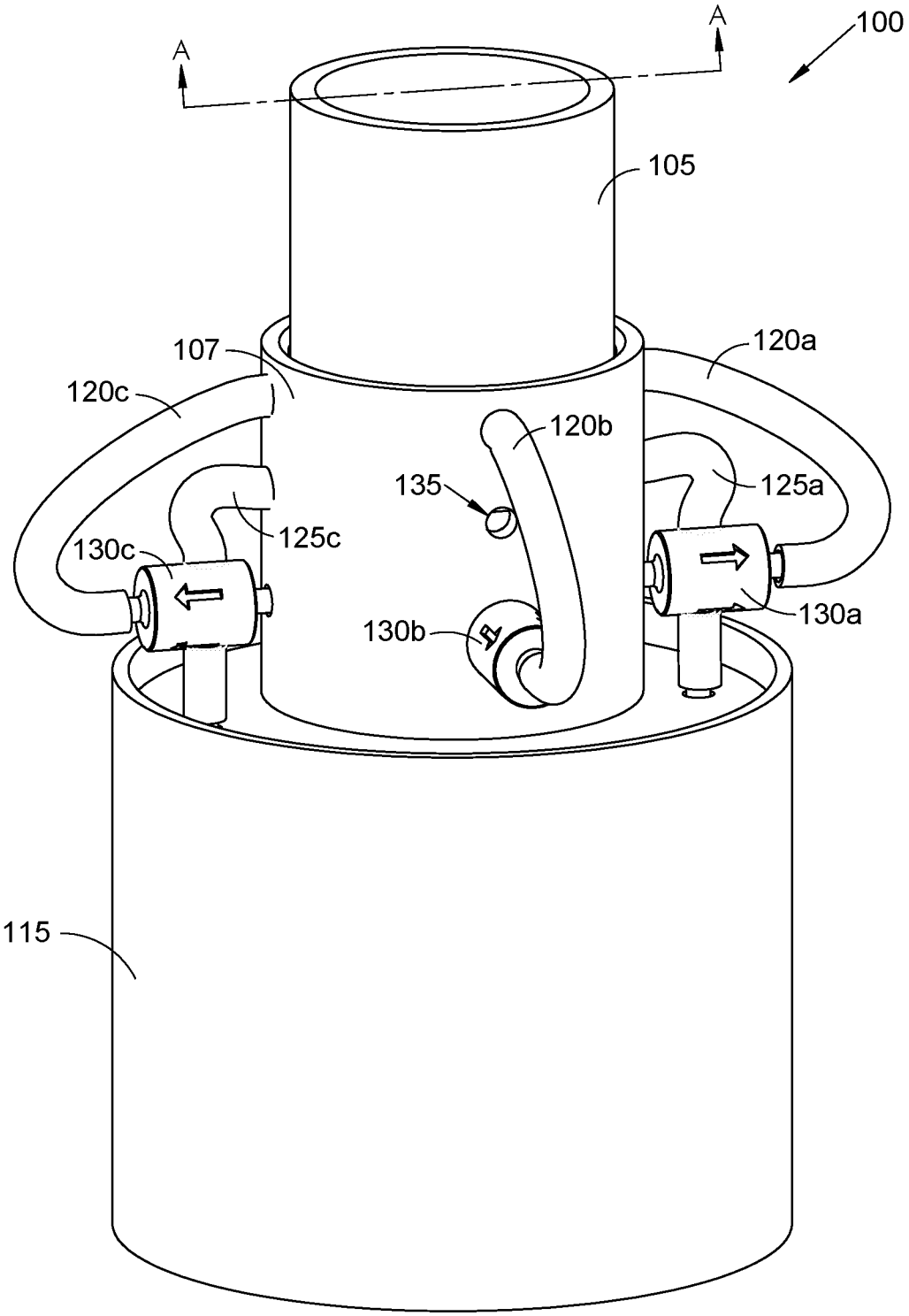
FIG. 1 is a perspective view of an applicator assembly mounted on a bonding compound container, according to one embodiment.

Plumbers and pipefitters join polymer pipe systems together using bonding compounds (such as fluid bonding compounds or bonding fluids). Current methods of applying these bonding compounds to exterior pipe surfaces and interior pipe fitting surfaces include brushes, daubers and/or rollers requiring several strokes or passes to insure proper surface area coverage. This process takes undue time and requires skill to produce consistent pipe joint reliability.

Pipe joining compounds can be in the form of glues, primers, and solvent cements; referred hereafter as simply 'bonding fluids'. Each of these different bonding fluids are used to prepare and join pipes and pipe fittings together to create piping systems. It's crucial each pipe joint is properly assembled to be water tight (or impervious to other fluids to be carried by the piping system) and structurally sound. Plumbers and pipe fitters need to apply the correct amount of bonding fluid across a sufficient surface area to insure a reliable joint is created. If too little bonding fluid is used the risk of a leaking joint is possible. Using too much bonding fluid can be wasteful and cause unintended 'bonding fluid curtains' inside the pipe joint where the excess bonding fluid can impede internal pipe flow and even cause clogs or backups. If too little surface area is covered with the bonding fluid the strength of the joint may be compromised and may not be water tight while too much coverage can result in waste and mess for the plumber. All the above elements may need to be considered while trying to minimize the time required to create each joint to reduce labor and associated costs.

Embodiments illustrated discussed herein describe a pump mechanism uniquely suited for viscous fluids and designed to apply a metered amount of bonding fluid uniformly across a prescribed surface area. The use of such a mechanism may reduce bonding fluid waste and mess, increase assembled pipe joint reliability, and reduce time necessary to apply bonding fluid to pipe joint assemblies.

At least some embodiments enable an ability to attach an applicator assembly to bonding fluid containers with a standard delta cap opening. In some embodiments, the pump may be permanently attached to an integrated bonding fluid reservoir or container. Furthermore, in at least some embodiments, the applicator assembly need not be in a vertical position for use. For example, a weighted suction line may allow for the use of the VFAP at angles approaching parallel to the ground. The weighted suction line may fall to, or near to, the lowest point of the container where bonding fluid will also reside providing sufficient fluid for pumping. Such embodiments may allow for recycling of unused bonding fluid through return valves after the assembly scrapes off excess bonding fluid prior to pipe joining. In at least one embodiment, return lines draw bonding fluid from a holding groove and back into the container. The pump may be self-priming by use of positive check valves.

Fundamentals and teachings found in the present disclosure may be more easily comprehended by referring to the drawings. Illustrations in drawings may not be to scale and are intended to assist the reader in understanding the disclosure. For brevity, Viscous Fluid Applicator Pump may be abbreviated as VFAP. While some embodiments illustrate a VFAP for a pipe, the same principles and a similar embodiment can be applied to a VFAP for a pipe fitting.

The illustrations depicted in the drawings are examples of possible embodiments and are not intended to be limiting in scope. Other similar embodiments are possible and are included as part of the spirit and scope of the present disclosure. Enlarged detail and cross-sectional views place emphasis on a particular principle or feature and are intended to assist the reader in comprehending the disclosure. Features depicted with companion numbers may be similar in nature but not necessarily exact in principle. It is to be understood that the following description is only by of examples of the principles of the present disclosure and should not be viewed as narrowing the claims which follow.

Referring now to FIG. 1, a perspective view of an applicator assembly 100 is shown. A pump 107 is attached to a bonding fluid container 115 with and a pipe 105 is shown positioned in the pump 107 prior to applying bonding fluid to an outside surface of the pipe. Supply check valves 130*a* and 130*b* and 130*c* (collectively supply check valves 130) supply bonding fluid in a forward direction via supply lines 120*a*, 120*b*,120*c* (collectively supply lines 120) to the outside pipe surface as the pump progresses downward. Ports 135, in connection with return lines 125*a* and 125*c* (return line corresponding to port 135 is omitted to avoid obscuring of port 135) (collectively return lines 125), recycle unused or scraped off bonding fluid as the pump progresses upward.

Figure 2A:
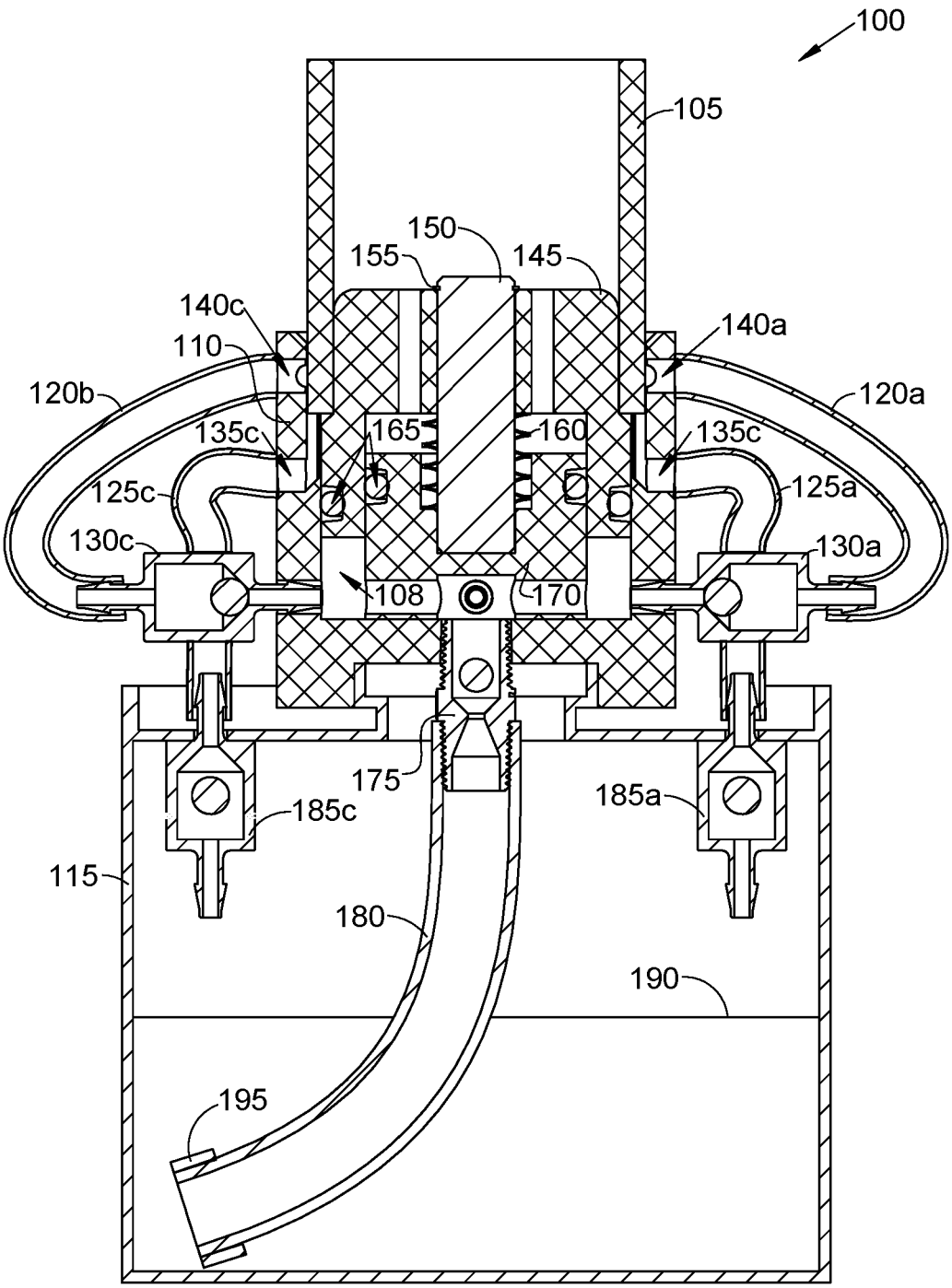
FIG. 2A illustrates a cross-sectional view of the applicator assembly of FIG. 1 with a pump piston in an up position, according to one embodiment.

FIG. 2A is a cross-sectional view of the applicator assembly 100 of FIG. 1 taken along section line A in FIG. 1. Shown are the inner components of applicator assembly 100. The pump contains three main parts: pump outer cylinder 110, pump inner cylinder 170, and pump piston 145. Sub-components include piston guide shaft 150, piston guide shaft retaining ring 155, piston spring 160, piston O-rings 165, suction line check valve 175, suction line 180, suction line weight 195, return check valves 185*a*, 185*c* (collectively return check valve 185) return line 125, supply check valve 130, supply line 120. FIG. 2A is shown with the pump piston 145 in an upward position. From the positions of the balls in the various check valves one can deduce the state of operation. For example, the position of the ball in the suction line check valve 175 indicates the pump is approaching the highest point of operation. Suction line check valve 175 is open with bonding fluid 190 being drawn up through suction line 180 into pump 107 into cavity 108. During the same instant, supply check valve 130 is closed while cavity 108 is being filled with bonding fluid 190. Cavity 108, at the pump's highest point of operation, is a predesigned volume that directly correlates to the metered volume of bonding fluid 190 to be applied to the outside surface of pipe 105. Return check valve 185 is open, drawing any excess bonding fluid 190 in port 135 through return line 125 into bonding fluid container 115. The flow of bonding fluid 190 through suction line 180 from bonding fluid container 115 generates a vacuum in bonding fluid container 115 that is used to open return check valve 185 and draw any excess bonding fluid in port 135 back into bonding fluid container 115. Piston spring 160 is approaching full extension. O-rings 165 maintain a positive seal against the inner walls of pump outer cylinder 110 and exterior walls of pump inner cylinder 170.

Figure 2B:
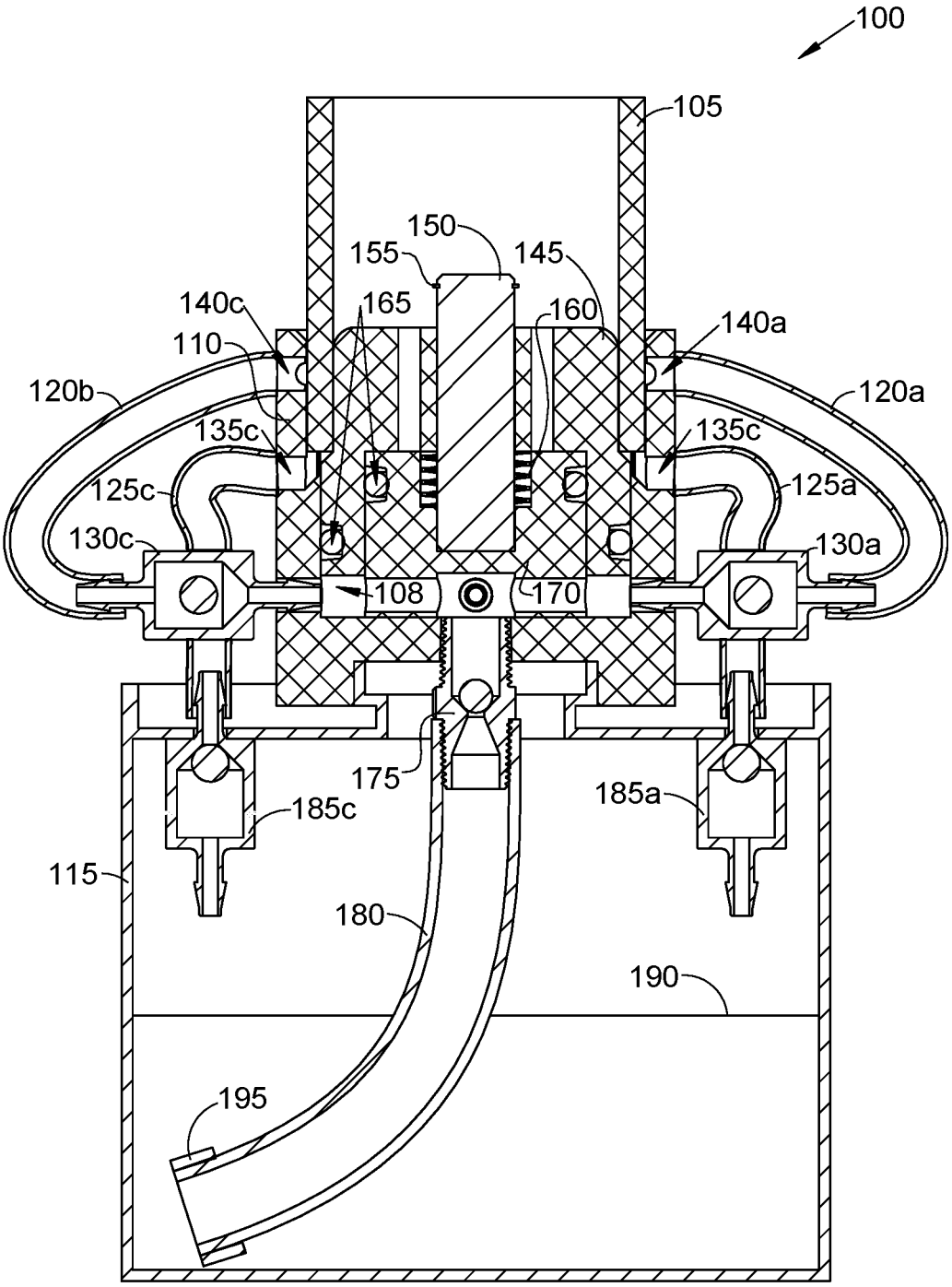
FIG. 2B illustrates a cross-sectional view of the applicator assembly of FIG. 1 with a pump piston in a down position, according to one embodiment.

FIG. 2B illustrates a cross-sectional view of the applicator assembly 100 of FIG. 1 taken along section line A in FIG. 1 with the pump piston 145 shown in a down position. From the positions of the balls in the various check valves one can deduce the state of operation. For example, the position of the ball in the suction line check valve 175 indicates the pump is approaching the lowest point of operation. Suction line check valve 175 is closed with bonding fluid 190 in cavity 108 being pumped through open supply check valve 130, supply line 120, and arriving at ports 140*a* and 140*c* (collectively port 140) at which point the bonding fluid 190 is deposited uniformly across a prescribed surface area on pipe 105. Piston spring 160 is approaching full compression. O-rings 165 maintain a positive seal against the inner walls of pump outer cylinder 110 and exterior walls of pump inner cylinder 170.

Figure 3A:
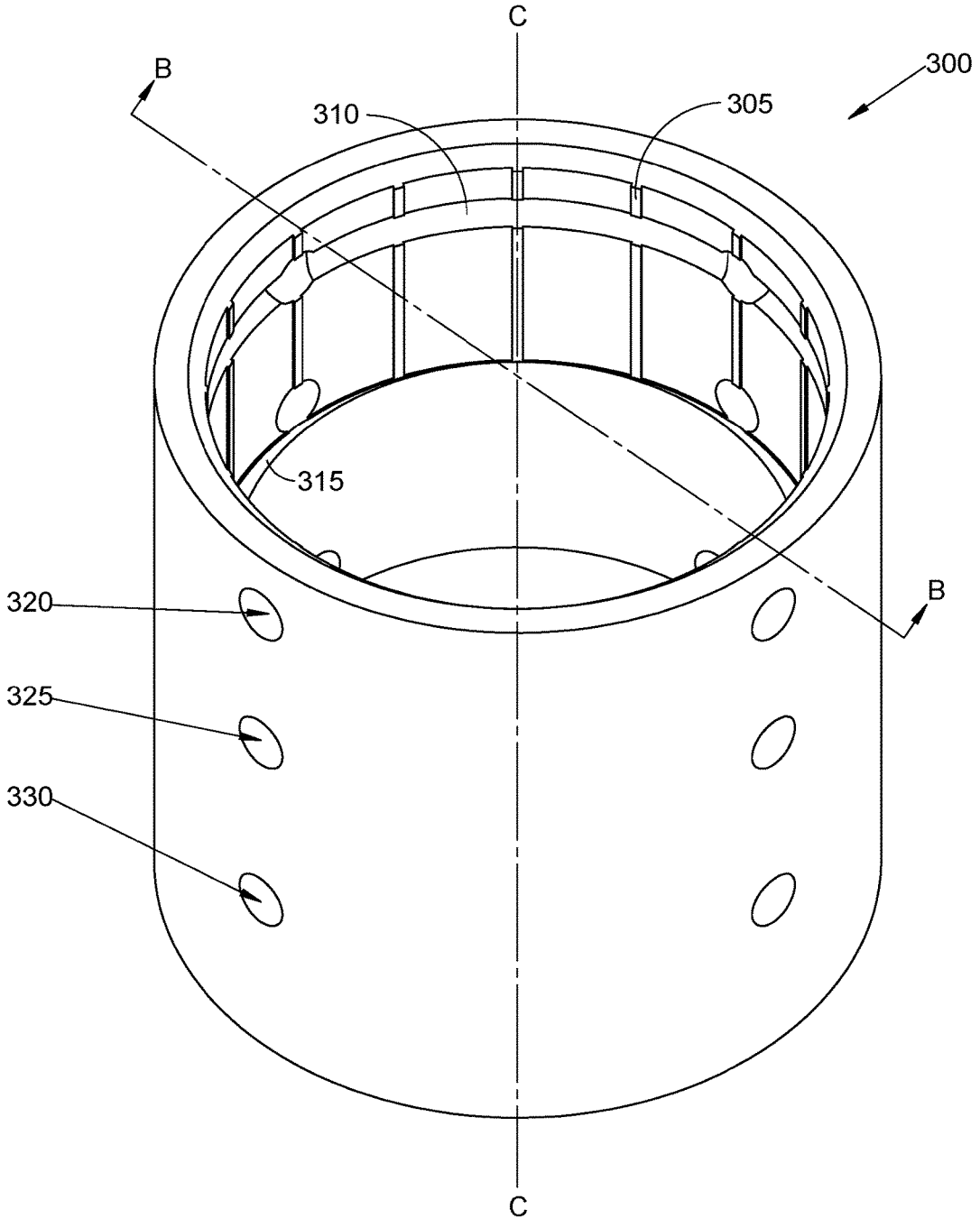
FIG. 3A is a perspective view of a pump outer cylinder, according to one embodiment.
Figure 3B:
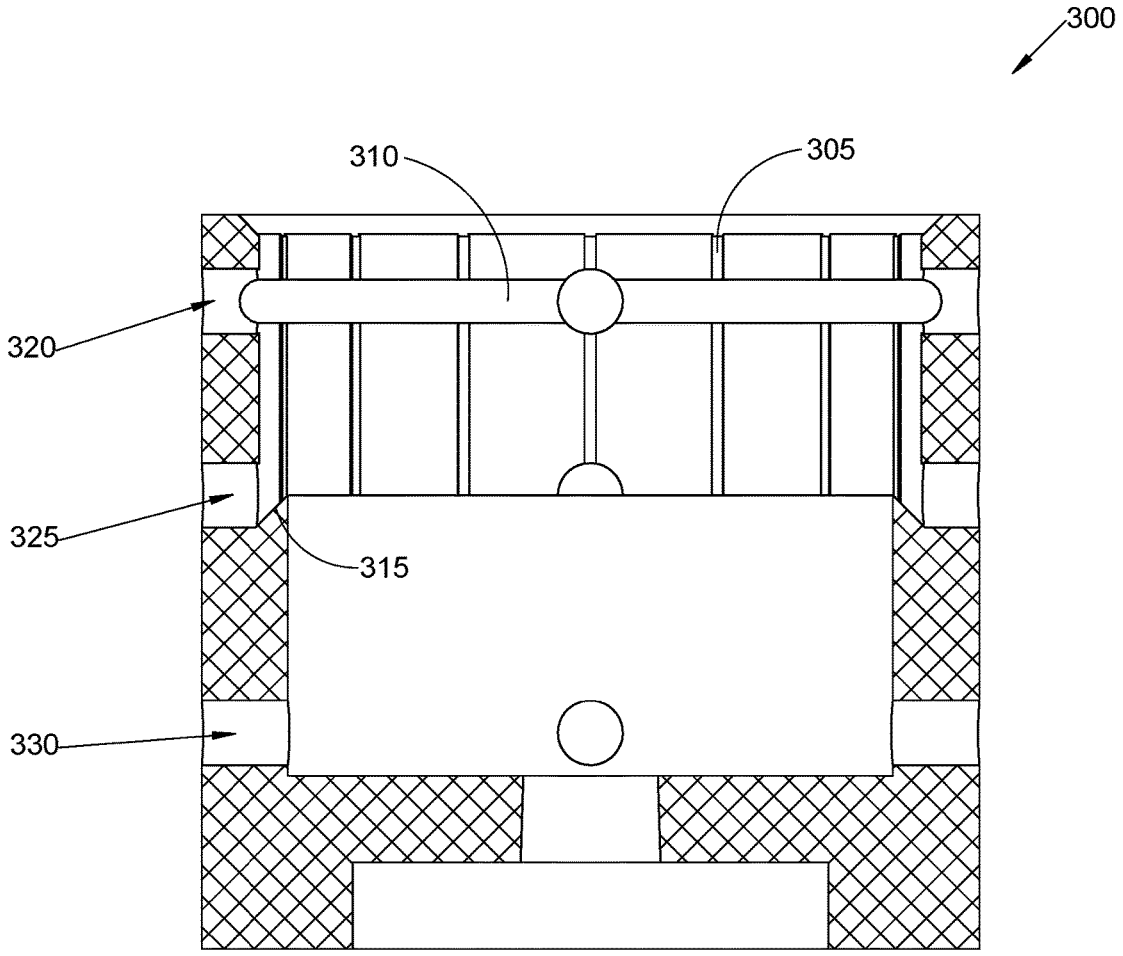
FIG. 3B is a cross-sectional view of the pump outer cylinder of FIG. 3A, according to one embodiment.

Turning to FIG. 3A is a perspective view of a pump outer cylinder 300 (such as the pump outer cylinder 110). FIG. 3B is a cross-sectional view along section line B of FIG. 3A of the pump outer cylinder 300. Pipe guide rails 305, running parallel to the main cylinder axis C, assists with the alignment of the pipe 105 in the pump 107 during operation while not impeding the uniform coverage of bonding fluid 190 on the outside surface of pipe 105. Supply groove 310, running circumferentially along the internal surface near the top of pump outer cylinder 300, allows for the bonding fluid 190 to spread uniformly around pipe 105 leaving a thin film adhered to the pipe 105 external surface during operation. Return groove 315, running circumferentially along the internal surface near the middle of pump outer cylinder 300, allows for excess or scraped off bonding fluid to collect and pool near port 325 in preparation to return to bonding fluid container 115 via return line 125. Supply port 320 and supply port 330 are connected via supply line 120 and supply check valve 130.

Figure 4A:
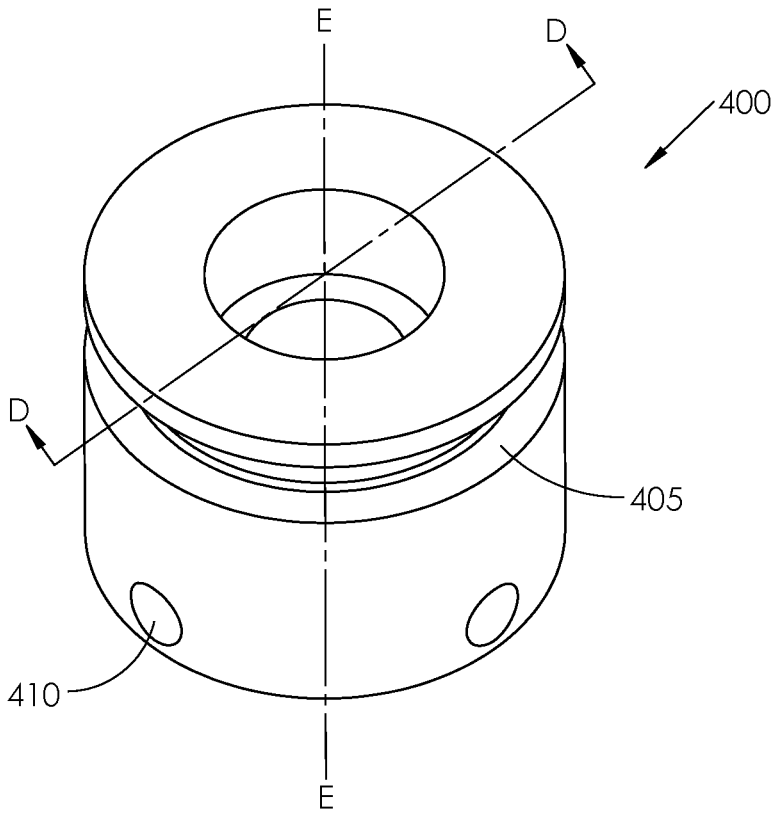
FIG. 4A is a perspective view of a pump inner cylinder, according to one embodiment.
Figure 4B:
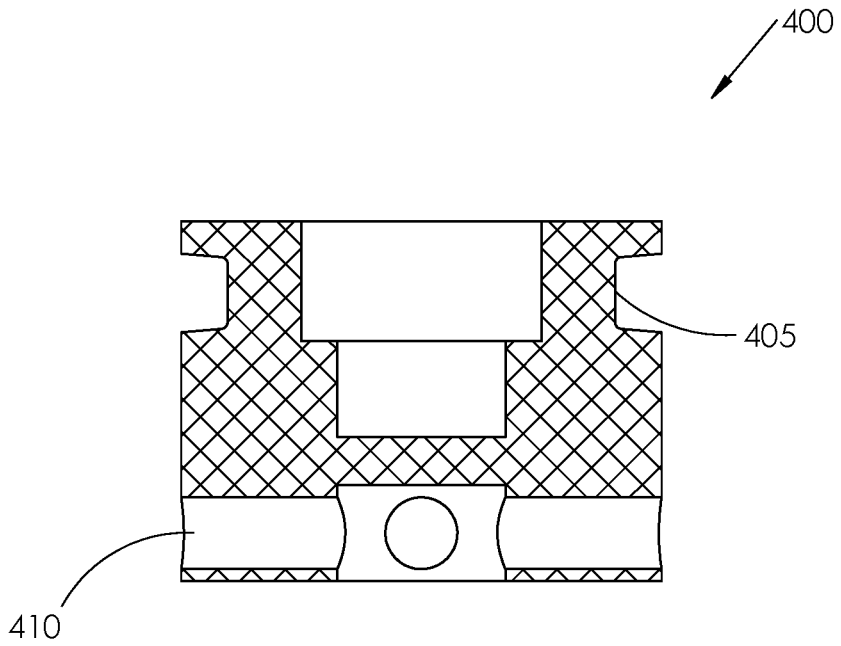
FIG. 4B is a cross-sectional view of the pump inner cylinder of FIG. 4A, according to one embodiment.

FIG. 4A is a perspective view of the pump inner cylinder 400 (such as pump inner cylinder 170). FIG. 4B is a cross-sectional view along section line D of FIG. 4A of the pump inner cylinder 400. O-ring groove 405, concentric about major axis E and along the outside upper surface of pump inner cylinder 400, provides a space for O-ring 165 to be retained and creates a positive seal against the inner surface of pump piston 145. Port 410 is a fluid conduit, supplying bonding fluid 190 to cavity 108.

Figure 5A:
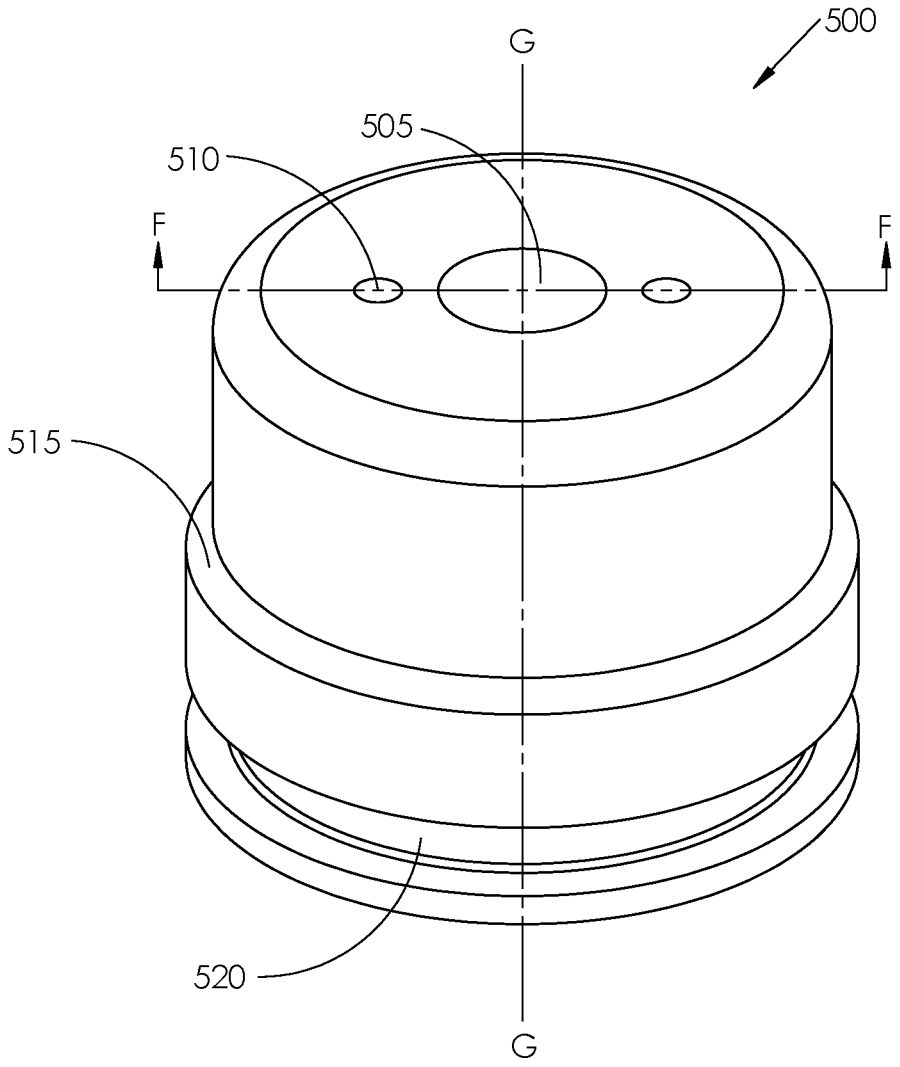
FIG. 5A is a perspective view of a pump piston, according to one embodiment.
Figure 5B:
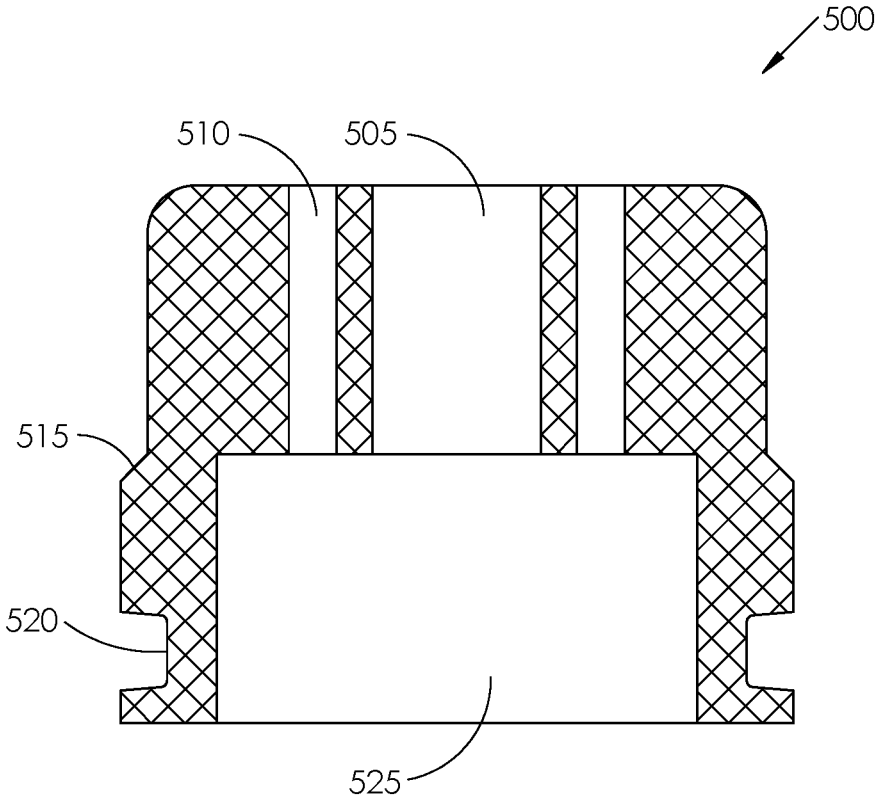
FIG. 5B is a cross-sectional view of the pump piston of FIG. 5B, according to one embodiment.

FIG. 5A is a perspective view of pump piston 500 and FIG. 5B is a cross-sectional view along section line F of FIG. 5A of the pump piston 500. Piston guide 505 interacts with piston guide shaft 150 allowing for sliding motion of the piston along the axis G. Piston vent 510 prevents pressure build-up or vacuum formation within the internal volume 525 of pump piston 500. Pipe rest 515 supports a pipe during the bonding fluid application process. The pipe rest 515 may receive pressure from and end of the pipe or fitting to actuate the pump piston 500 and thereby actuate the pump. O-ring groove 520, concentric about major axis G and along the outside lower surface of pump piston 500, provides a seal with pump outer cylinder 110.

Figure 6A:
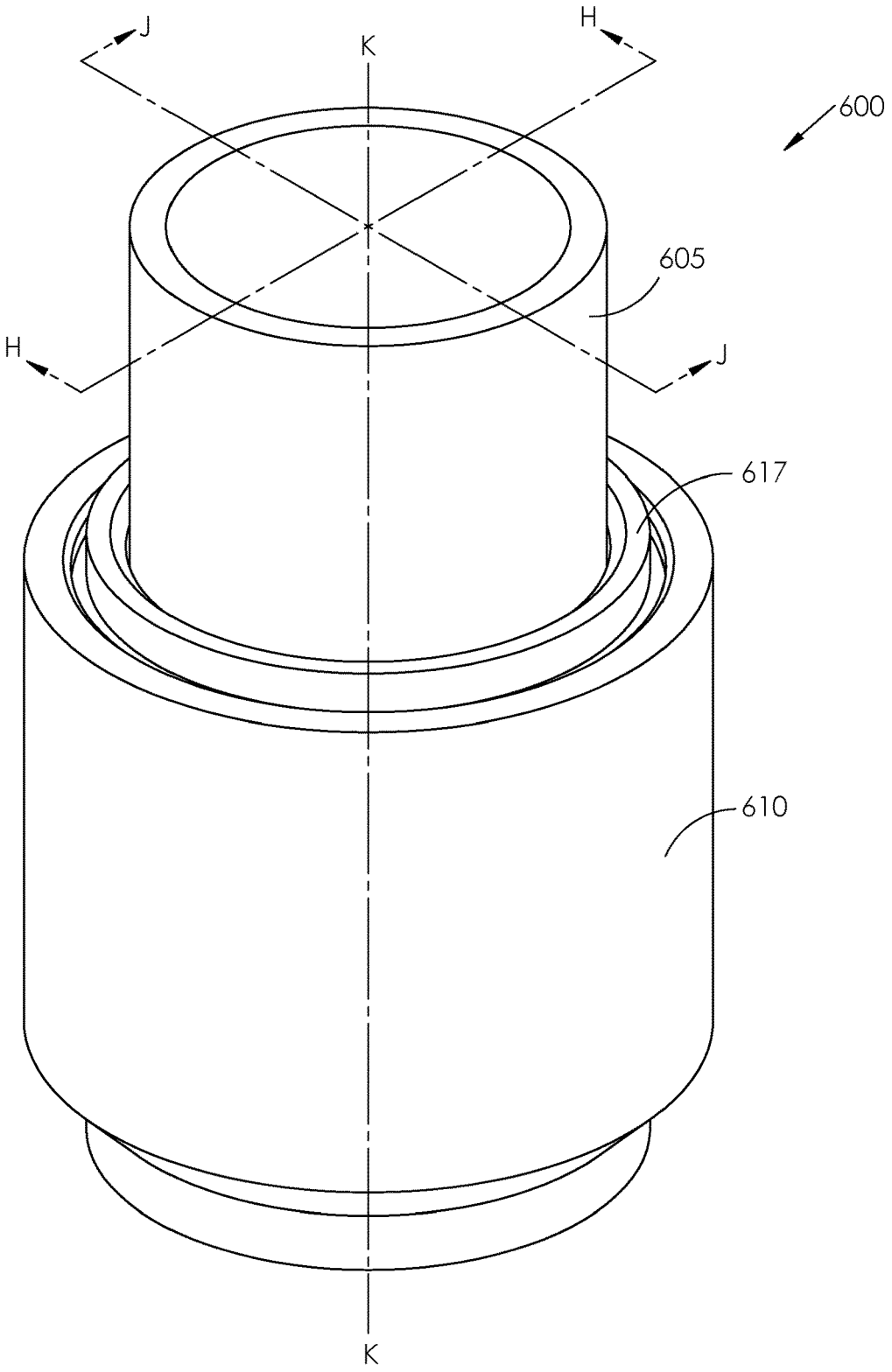
FIG. 6A is a perspective view of an applicator assembly, according to another embodiment.

Referring now to FIG. 6A, shown is a perspective view of an applicator assembly 600. FIGS. 1-5 illustrate one embodiment of an applicator assembly and FIGS. 6A-6D illustrate another embodiment. The embodiments of FIGS. 6A-6D may represent an embodiment enabling improved manufacturing, cost, and ease of use. FIGS. 6A-6D omit the container and a suction line, though they may be present during operation. The applicator assembly 600 includes internal channels for supply lines, return lines, and the like. This may help to reduce the number of parts as well as reduce assembly and manufacturing costs. The applicator assembly 600 includes a pump outer cylinder 610, pump middle cylinder 617, and pipe 605. The applicator assembly 600 may be capable of screwing directly onto a stock bonding fluid container with matching Delta threads, which may eliminate the need for bonding fluid container customization. The applicator assembly 600 may be understood as employing the same or similar working principles as those disclosed in relation to FIGS. 1-5.

Figure 6B:
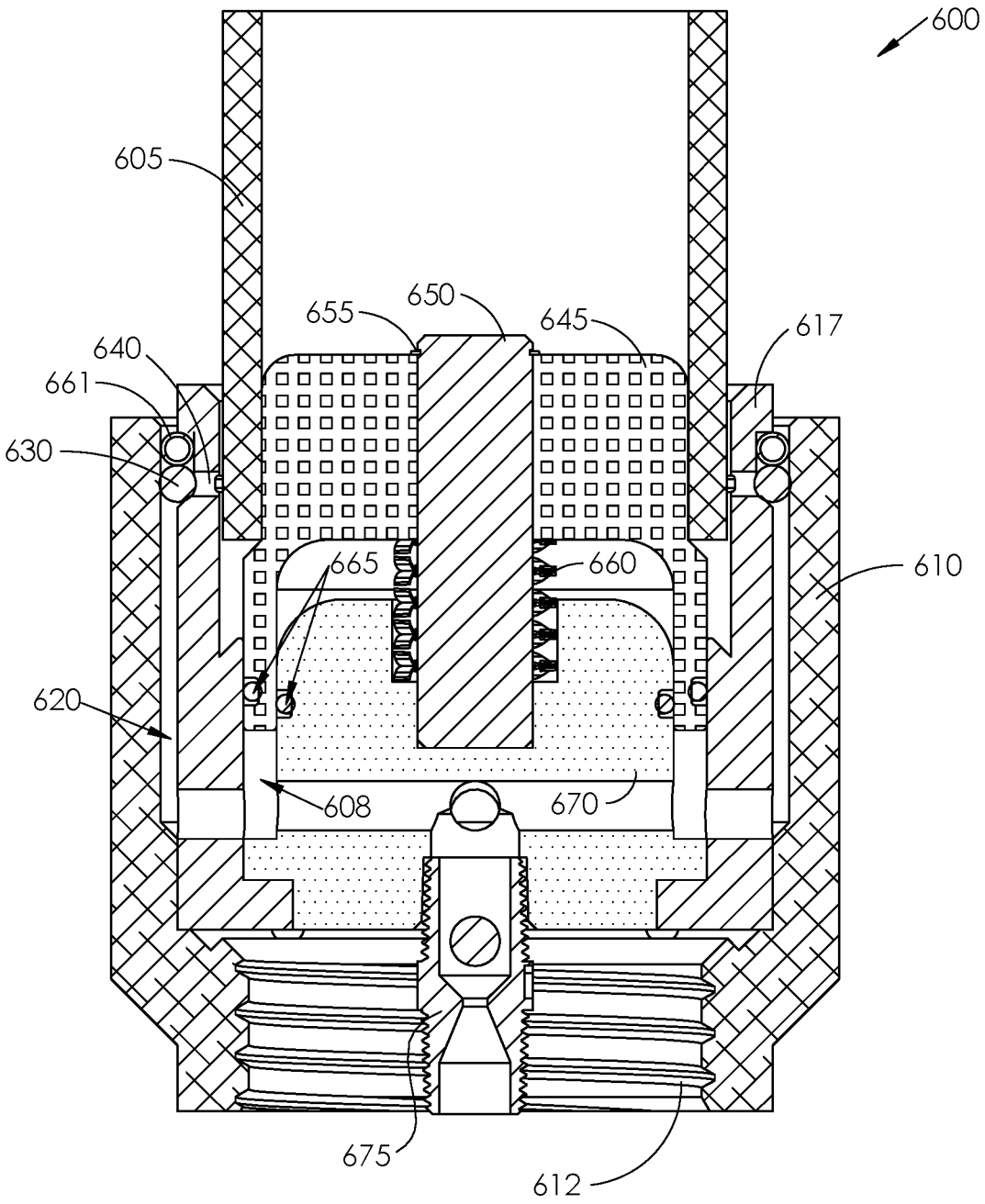
FIG. 6B is a cross-sectional view of the applicator assembly of FIG. 6A with a pump piston in an up position illustrating a supply check valve mechanism, according to one embodiment.

FIG. 6B is a cross-sectional view along section line H of FIG. 6A. The applicator assembly 600 includes a pump piston 645 allowing fluid flow through check valve 675, cavity 608, and supply channel 620. Supply channels 620 may conceptually replace the functionality of the supply lines 120 of other embodiments. A reduced number of check vales are needed with only a single supply check valve mechanism 630 and 661 located just prior to port 640. The mechanism seals along the upper portion of supply channel 620 with an O-ring, analogous to the ball of a check valve, and is held in a check position with a hollow tube 661 acting as a spring; collapsing and returning to its original shape depending on operational position. From the position of the ball in suction check valve 675 one can deduce the state of operation. The pump piston 645 is approaching the highest point of operation. Suction check valve 675 is open with bonding fluid 190 being drawn up through suction line 180 into pump 600 into cavity 608. Additionally, supply check valve mechanism 630 and 661 is closed while cavity 608 is being filled with bonding fluid 190. Cavity 608, at the pump's highest point of operation, is a predesigned volume that directly correlates to the metered volume of bonding fluid 190 to be applied to the outside surface of pipe 605. Piston guide shaft retaining ring 655 prevents pump piston 645 from moving past a predetermined upper position during operation. Delta threads 612 effectively interact with mating Delta threads of a bonding fluid container 115. Other components not explicitly noted here correspond with like components described in FIGS. 1-5.

Figure 6C:
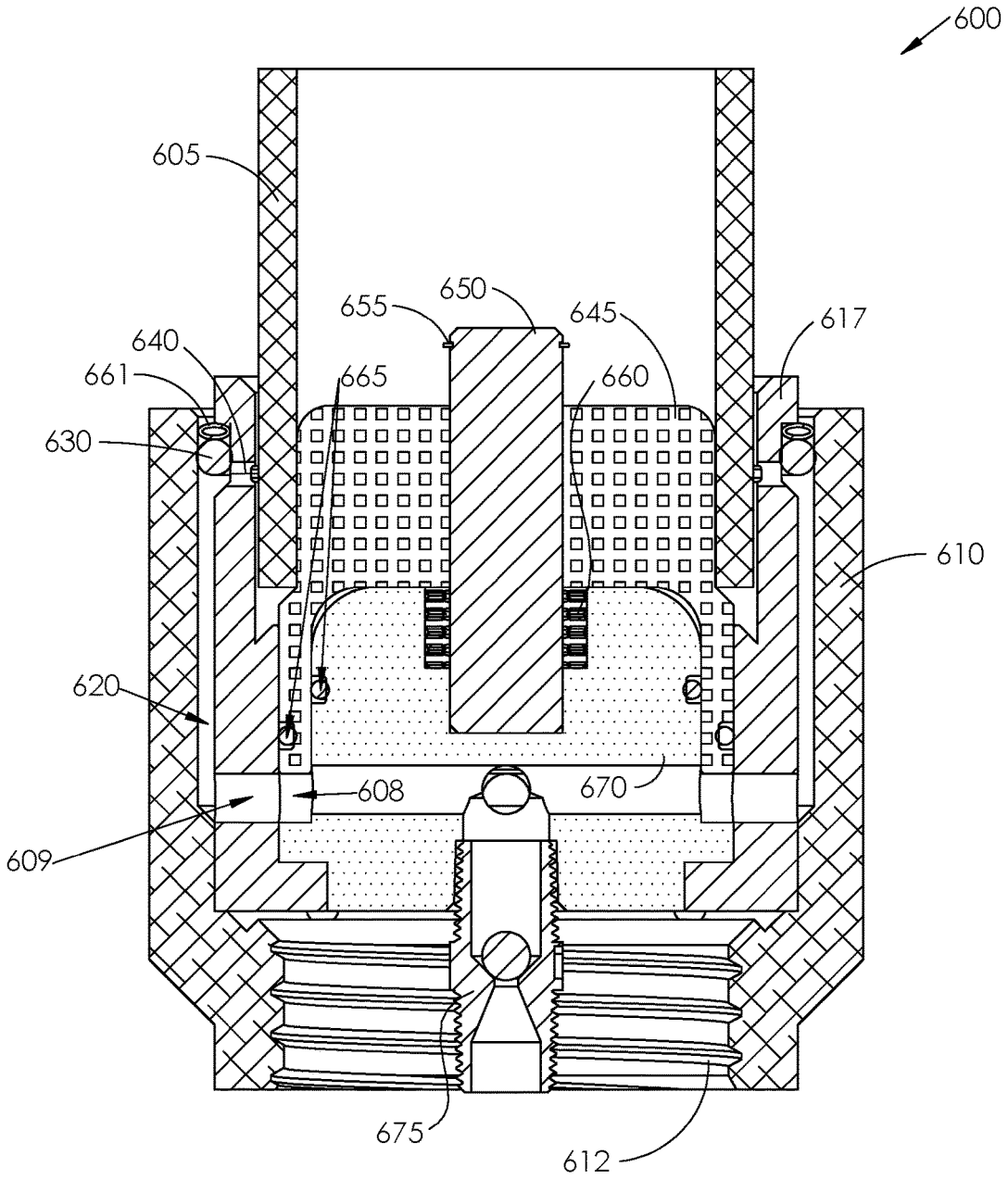
FIG. 6C is a cross-sectional view of the applicator assembly of FIG. 6A with a pump piston in a down position illustrating a supply check valve mechanism, according to one embodiment.

FIG. 6C is a cross-sectional view about line H of FIG. 6A revealing piston function and resultant fluid flow through check valve 675, cavity 608, and fluid channel 620. From the position of the ball in suction check valve 675 one can deduce the state of operation. The pump piston 645 is approaching the lowest point of operation. Suction check valve 675 is closed with bonding fluid being pumped through supply channel 620, open supply check valve mechanism 630 and 661, and arriving at ports 640 at which point the bonding fluid 190 is deposited uniformly across a prescribed surface area on pipe 605. Piston spring 660 is approaching full compression. O-rings 665 maintain a positive seal against the inner walls of pump middle cylinder 617 and exterior walls of pump inner cylinder 670. Piston guide shaft 650 provides stability for pump piston 645 during pump operation.

Figure 6D:
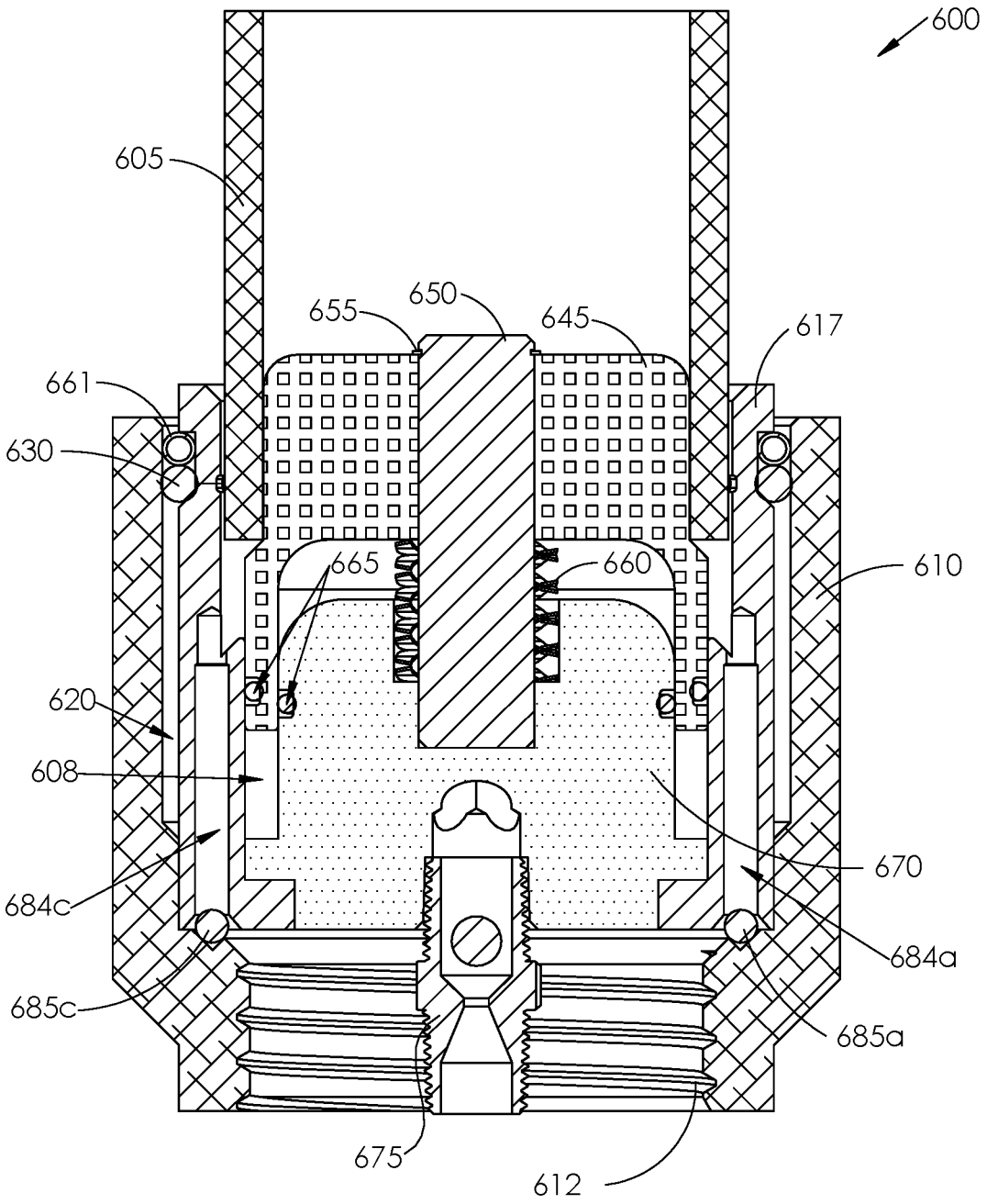
FIG. 6D is another cross-sectional view of the applicator assembly of FIG. 6A with a pump piston in an up position illustrating the integrated fluid return check valve mechanism, according to one embodiment.

FIG. 6D is a cross-sectional view along section line J of FIG. 6A. This view reveals the integrated fluid return check valve mechanism 684*a-c* and 685*a-c* (collectively return check valve mechanism 684 and 685). These check valves are positioned 90 degrees offset from passage 609 shown in FIG. 6C about major axis K of FIG. 6A. They utilize balls just as traditional ball check valves but are more compact with their housings integrated within the wall of pump middle cylinder 617. These check valves can be, but are not required to be, actively checking. This embodiment depicts passive checking which becomes active if pump 600 is inverted; with gravity positioning the balls in a sealing location near the top of return channel 684. Bonding fluid 190 in return channel 684 can pass by the return check ball 685 when return check ball 685 is in the bottom position as shown in FIG. 6D. Return check ball 685 is contained in the bottom position with sufficient clearance around it to allow bonding fluid to pass by returning to bonding fluid can 115 to be reused during a future pump cycle.

It's noted that the descriptions and principles presented above are examples of a possible embodiments and that many such derivations can and do exist that employ the same fundamentals and working principles. These other possible embodiments exist without departing from the basic principles herein and are therefore included and protected as part of this disclosure. For example, channels or other pathways can be used in leu of supply lines or tubes. Also, other means of creating a check valve mechanism other than the traditional ball check valve can be used and is apparent to one skilled in the art. Different spring types can be used other than the traditional metal coil type. As previously noted, these same working principles can be applied to a pump that applies bonding fluid on the interior surface of pipe fittings without deviating substantially from the spirit of this disclosure, and as such is included and protected by this disclosure. Also, the use of the described pump is not limited to cylindrical shapes exclusively. Any cross-sectional shape where bonding fluid can be applied on the exterior or internal surface of said shape are included in this disclosure. All these iterations, combinations, examples, and embodiments of this disclosure are protected by the following claims.

An applicator assembly may include a pump and a pipe or pipe fitting guide or fixture. A portion of the applicator assembly may move with pipe or pipe fitting during pump operation. An applicator assembly may include a pump comprising integrated and non-integrated fluid channels, ports, hoses, tubes, and/or cavities. Channels may be formed from an internal diameter or internal surface of one cylinder or any shape and outside diameter or external surface of mating adjacent cylinder or any shape.

Channels may be formed by machining operations, molding operations, stamping operations, drawing operations, and extrusion operations of a single cylinder or any shape or multiple cylinders or shapes. Channels may include hoses or tubes routed through or to ports, affixed to ports, external to pump, or internal to pump. Cavities may act as channels or ports. A pump may include check valves that are externally mounted, internally mounted, integrated within pump, and/or integrated within pump component walls. O-rings and hollow tubing may be utilized to create a check valve mechanism. Integrated check valve housing may utilize wall of supporting components. Passive check valves may be gravity activated. An applicator assembly may include means of mounting a container, including one or more of matching and mating threads of pump and container, an integrated container-pump assembly, a quick connect and disconnect to container, a press-fit, and/or a single body pump-container.

An applicator assembly may include a flexible and weighted suction line. The Weighted flex line may fall to a lowest location of container dependent on global orientation of container with respect to earth. The flex line with swivel feature may assist by allowing more degrees of freedom.

In one embodiment, a specialized applicator pump attaches to the top of viscous fluid containers. The pump applies a metered amount of fluid uniformly across cylindrical or any other shaped rod, pipe or fitting on the exterior and/or interior surfaces. Targeted surface areas are completely "wetted" with a film of fluid that remains on the object. At least one use includes the application of bonding fluid or adhesives to bonding surfaces prior to joining parts together. At least one embodiment reduces time for application of bonding fluid. At least one embodiment provides repeatable metered adhesive application resulting in reduced waste. At least one embodiment enables uniform application across a surface area to promote a proper bond between joining parts. At least some embodiments are for pipe-end cylindrical exterior surface adhesive application. Another embodiment that is closely related but not shown is for fitting cylindrical interior surface adhesive application.

In at least one embodiment, the applicator assembly need not be positioned perfectly vertical for operation. A weight on the end of a flexible suction line causes the end of the suction line to move to the lowest position in the fluid container where viscous fluid or adhesive will be located when fluid container is at a position other than perfectly vertical.

Further examples, with aspects that may be combined with aspects of previous embodiments, are discussed below.

An apparatus, such as a VFAP or an applicator assembly, may include an applicator member and a pump. Examples of an applicator member may include one or more of the pump outer cylinder 110, pump outer cylinder 300, and/or pump outer cylinder 610. The applicator member may include an applicator surface substantially matching a surface of a pipe or fitting. The applicator surface may match a size and shape of the pipe or fitting while allowing sufficient different to allow one to fit within the other and/or to allow a bonding fluid to flow between. The applicator surface may include a region between a portion of an applicator assembly and the surface of the pipe or fitting to which a bonding fluid is to be applied. For example, the applicator surface may include at least a portion of the interior surface of the pump outer cylinder 300. The surface of the pipe or fitting may include at least a portion of an interior or exterior surface of the pipe or fitting. Examples of the pump may include the channels, valves, and ports shown in previous embodiments. The pump may cause a fluid to flow via one or more channels onto the applicator surface. Examples of the one or more channels may include one or more of supply lines 120 and supply channels 620 or other channels for conveying fluid. When the pipe or fitting is positioned within or around the applicator surface the pump may cause the fluid to flow in a forward direction and into a region between the applicator surface and the surface of the pipe or fitting, thereby applying the fluid to the surface of the pipe or fitting.

The surface of the pipe or fitting may include an outer surface or inner surface of a pipe or fitting. The surface of the pipe or fitting may include at least the portion of the exterior surface of the pipe or fitting and the applicator surface may extend around a circumference of the at least the portion of the exterior surface when the pipe or fitting is positioned within the applicator member. The surface of the pipe or fitting comprises at least the portion of the interior surface of the pipe or fitting, wherein the at least the portion of the interior surface of the pipe or fitting extends around a circumference of the applicator surface when the pipe or fitting is positioned around the applicator member.

The applicator member may include one or more ports (such as ports 140 or ports 640) to allow fluid to pass through the applicator member onto the applicator surface. The pump may cause the fluid to flow through one or more channels through the one or more ports when the pump is actuated. The one or more channels may be formed integrally with at least a portion of the applicator member. The channels may guide the fluid to the ports and/or into one or more supply grooves.

The apparatus may include one or more supply grooves (such as supply groove 310) formed by at least a portion of the applicator surface, wherein fluid is pumped into the one or more supply grooves. The one or more supply grooves alone or together may extend substantially around an interior or exterior circumference of the applicator surface perpendicular to a receiving axis of the applicator member to allow the fluid to be applied substantially completely around a circumference of the surface of the pipe or fitting. For example, the supply grooves may ensure that bonding fluid is distributed fairly evenly around a circumference of the pipe or fitting on the surface of the pipe or fitting. The applicator surface may include one or more guide rails. The fluid may include a bonding fluid. The applicator surface may be made from or coated with a material that is substantially neutral to or non-reactant to the bonding fluid.

The apparatus may include a piston for actuating the pump (such as position 145 or piston 645) and a bias member (such as piston spring 160 or spring 660) biasing the piston to a default position. Pressure applied to the pipe or fitting relative to the apparatus actuates the piston causing the pump to induce flow of the fluid through the one or more channels. The apparatus may include one or more valves (such as supply check valves 130, suction line check valve 175, return check valve 185, check valve 675) to limit reverse flow of the fluid through the pump or one or more ports of the apparatus. The one or more valves may include one or more of a valve integrated with the pump, one or more check valves, one or more passive check valves, or one or more valves positioned within or near an end of the one or more channels.

The apparatus may include a suction line (such as suction line 180) in fluid communication with the pump. The suction line may include a proximal end and a distal end. The distal end may be weighted to cause the distal end to fall to a lower region of a fluid container due to gravity. The proximal end or a portion of the apparatus may be mounted using a rotation member to allow the suction line to rotate with respect to a fluid container. The apparatus may include an attachment portion for selectively attaching the apparatus to a fluid container for holding the fluid.

An apparatus may include an applicator surface, one or more ports, and one or more supply grooves. The applicator surface may substantially match a surface of a pipe or fitting, the surface of the pipe or fitting including at least a portion of an interior or exterior surface of the pipe or fitting. The one or more ports to allow fluid to pass through the applicator member onto the applicator surface. The one or more supply grooves may be formed by at least a portion of the applicator surface. The fluid may be pumped through the one or more ports into the one or more supply grooves to provide the fluid to the surface of the pipe or fitting when the pipe or fitting is positioned within or around the applicator surface. The one or more supply grooves alone or together may extend substantially around an interior or exterior circumference of the applicator surface perpendicular to a receiving axis (such as an axis perpendicular to the main cylinder axis C of FIG. 3A or line K of FIG. 6A) of the apparatus to allow the fluid to be applied substantially completely around a circumference of the surface of the pipe or fitting.

A method for applying a bonding fluid may include providing an apparatus including an applicator member. The applicator member may include an applicator surface, a pump, one or more ports to allow a fluid to pass through the applicator member onto the applicator surface, and one or more supply grooves formed by at least a portion of the applicator surface. The method may include placing a portion of the pipe or fitting into or around the applicator member. The method may include applying pressure to the pipe or fitting relative to the apparatus to actuate the pump. The pump may induce flow of the fluid through the ports into the one or more supply grooves to apply the fluid to the surface of the pipe or fitting. The method may include removing the pipe or fitting from the applicator member and placing the pipe or fitting on or in a corresponding pipe or fitting whereby the fluid bonds the pipe or fitting to the corresponding pipe or fitting.

Example embodiments and accompanying drawings are discussed in reference to the numerals provided therein so as to enable one skilled in the art to practice the principles and disclosed embodiments. The skilled artisan will understand, however, that the apparatuses, systems and methods described herein can be practiced without employing these specific details, or that they can be used for purposes other than those described herein. Indeed, they can be modified and can be used in conjunction with products and techniques known to those of skill in the art in light of the present disclosure. The drawings and descriptions are intended to be examples of various aspects of the disclosure and are not intended to narrow the scope of the appended claims. Furthermore, it will be appreciated that the drawings may show aspects in isolation and the elements in one figure may be used in conjunction with elements shown in other figures.

Reference in the specification to "one configuration" "one embodiment," "a configuration" or "an embodiment" means that a particular feature, structure, or characteristic described in connection with the configuration is included in at least one configuration, but is not a requirement that such feature, structure or characteristic be present in any particular configuration unless expressly set forth in the claims as being present. The appearances of the phrase "in one configuration" in various places may not necessarily limit the inclusion of a particular element of the disclosure to a single configuration, rather the element may be included in other or all configurations discussed herein.

Furthermore, the described features, structures, or characteristics of configurations of the disclosure may be combined in any suitable manner in one or more configurations. In the description, numerous specific details are provided, such as examples of products or manufacturing techniques that may be used, to provide a thorough understanding of configurations of the disclosure. One skilled in the relevant art will recognize, however, that configurations of the disclosure may be practiced without one or more of the specific details, or with other methods, components, materials, and so forth. In other instances, well-known structures, materials, or operations are not shown or described in detail to avoid obscuring aspects of the disclosure.

It should be understood that the present disclosure is not limited to any particular structures, process steps, or materials discussed or disclosed herein, but is extended to include equivalents thereof as would be recognized by those of ordinarily skill in the relevant art. More specifically, the disclosure is defined by the terms set forth in the claims appended hereto, any future claims submitted here and in different applications, and their equivalents. It should also be understood that terminology contained herein is used for the purpose of describing particular aspects of the disclosure only and is not intended to limit the disclosure to the aspects or configurations shown unless expressly indicated as such. Likewise, the discussion of any particular aspect of the disclosure is not to be understood as a requirement that such aspect is required to be present apart from an express inclusion of the aspect in the claims.

It should also be noted that, as used in this specification and the appended claims, singular forms such as "a," "an," and "the" may include the plural unless the context clearly dictates otherwise. Thus, for example, reference to "a heating element" may include one or more of such heating elements, and reference to "the backing" may include reference to one or more of such layers.

As used herein, the term "substantially" refers to the complete or nearly complete extent or degree of an action, characteristic, property, state, structure, item, or result to function as indicated. For example, an object, such as tubing, that is "substantially" enclosed would mean that the object is either completely enclosed or nearly completely enclosed. The exact allowable degree of deviation from absolute completeness may in some cases depend on the specific context, such that enclosing nearly all of the length of a piece of tubing would be substantially enclosed, even if the distal end of the structure enclosing the tubing had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

While the embodiments of the disclosure have been described in particular with reference to certain illustrated configurations, such is not intended to limit the scope of the disclosure. The disclosure encompasses other specific forms without departing from its spirit or essential characteristics. The described configurations are to be considered as illustrative and not restrictive. The scope of the disclosure is to be defined by the claims appended hereto, any future claims submitted here and in different applications, and their equivalents. All changes which come within the meaning and range of equivalency of the claims are to be embraced within their scope.

The invention claimed is:

1. An apparatus comprising:

an applicator member comprising an applicator surface substantially matching a surface of a pipe or fitting, the surface of the pipe or fitting comprising at least a portion of an interior or exterior surface of the pipe or fitting; and a pump to cause a fluid to flow via one or more channels onto the applicator surface;

wherein when the pipe or fitting is positioned within or around the applicator surface the pump causes the fluid to flow between the applicator surface and the surface of the pipe or fitting applying the fluid to the surface of the pipe or fitting.

2. The apparatus of claim 1, wherein the surface of the pipe or fitting comprises at least the portion of the exterior surface of the pipe or fitting, wherein the applicator surface extends around a circumference of the at least the portion of the exterior surface when the pipe or fitting is positioned within the applicator member.

3. The apparatus of claim 1, wherein the surface of the pipe or fitting comprises at least the portion of the interior surface of the pipe or fitting, wherein the at least the portion of the interior surface of the pipe or fitting extends around a circumference of the applicator surface when the pipe or fitting is positioned around the applicator member.

4. The apparatus of claim 1, wherein the applicator member comprises one or more ports to allow fluid to pass through the applicator member onto the applicator surface.

5. The apparatus of claim 4, wherein the pump causes the fluid to flow through one or more channels through the one or more ports when the pump is actuated.

6. The apparatus of claim 4, wherein the one or more channels are formed integrally with at least a portion of the applicator member.

7. The apparatus of claim 1, further comprising one or more supply grooves formed by at least a portion of the applicator surface, wherein fluid is pumped into the one or more supply grooves.

8. The apparatus of claim 7, wherein the one or more supply grooves alone or together extend substantially around an interior or exterior circumference of the applicator surface perpendicular to a receiving axis of the applicator member to allow the fluid to be applied substantially completely around a circumference of the surface of the pipe or fitting.

9. The apparatus of claim 1, further comprising one or more guide rails on the applicator surface.

10. The apparatus of claim 1, wherein the fluid comprises a bonding fluid, wherein the applicator surface comprises or is coated with a material that is substantially neutral to or non-reactant to the bonding fluid.

11. The apparatus of claim 1, further comprising a piston for actuating the pump and a bias member biasing the piston to a default position.

12. The apparatus of claim 11, wherein pressure applied to the pipe or fitting relative to the apparatus actuates the piston causing the pump to induce flow of the fluid through the one or more channels.

13. The apparatus of claim 1, further comprising one or more valves to limit reverse flow of the fluid through the pump or one or more ports of the apparatus, the one or more valves comprising one or more of:

a valve integrated with the pump;

one or more check valves;

one or more passive check valves; or one or more valves positioned within or at an end of the one or more channels.

14. The apparatus of claim 1, further comprising a suction line in fluid communication with the pump, the suction line comprising a proximal end and a distal end.

15. The apparatus of claim 14, wherein the distal end is weighted to cause the distal end to fall to a lower region of a fluid container due to gravity.

16. The apparatus of claim 14, wherein the proximal end or a portion of the apparatus is mounted using a rotation member to allow the suction line to rotate with respect to a fluid container.

17. The apparatus of claim 1, further comprising an attachment portion for selectively attaching the apparatus to a fluid container for holding the fluid.

18. An apparatus comprising:

an applicator surface substantially matching a surface of a pipe or fitting, the surface of the pipe or fitting comprising at least a portion of an interior or exterior surface of the pipe or fitting;

one or more ports to allow fluid to pass through the applicator member onto the applicator surface; and one or more supply grooves formed by at least a portion of the applicator surface, wherein fluid may be pumped through the one or more ports into the one or more supply grooves to provide the fluid to the surface of the pipe or fitting when the pipe or fitting is positioned within or around the applicator surface.

19. The apparatus of claim 18, wherein the one or more supply grooves alone or together extend substantially around an interior or exterior circumference of the applicator surface perpendicular to a receiving axis of the apparatus to allow the fluid to be applied substantially completely around a circumference of the surface of the pipe or fitting.

20. A method comprising:

providing an apparatus comprising an applicator member, the applicator member comprising:

an applicator surface;

a pump;

one or more ports to allow a fluid to pass through the applicator member onto the applicator surface; and one or more supply grooves formed by at least a portion of the applicator surface;

placing a portion of the pipe or fitting into or around the applicator member, the applicator surface substantially matching a surface of the pipe or fitting, the surface of the pipe or fitting comprising at least a portion of an interior or exterior surface of the pipe or fitting;

applying pressure to the pipe or fitting relative to the apparatus to actuate the pump, wherein the pump induces flow of the fluid through the ports into the one or more supply grooves, wherein fluid is applied to the surface of the pipe or fitting;

removing the pipe or fitting from the applicator member; and placing the pipe or fitting on or in a corresponding pipe or fitting whereby the fluid bonds the pipe or fitting to the corresponding pipe or fitting.

* * * * *